United States Patent [19]

Kramer

[11] 4,173,255

[45] Nov. 6, 1979

[54] LOW WELL YIELD CONTROL SYSTEM AND METHOD

[76] Inventor: Richard W. Kramer, R.D. #2, Box 490B, Northumberland, Pa. 17857

[21] Appl. No.: 948,810

[22] Filed: Oct. 5, 1978

[51] Int. Cl.[2] ..... E21B 43/12; F01B 25/00; F04B 49/00

[52] U.S. Cl. ..... 166/314; 166/54; 415/11; 417/278; 417/279; 417/440; 137/411

[58] Field of Search ..... 417/278, 61, 279, 306, 417/440, 53; 415/11; 166/314, 54, 68, 68.5, 105, 112, 53; 137/386, 429, 411

[56] References Cited

U.S. PATENT DOCUMENTS

| | | | |
|---|---|---|---|
| 527,346 | 10/1894 | Rayner | 137/411 |
| 611,967 | 10/1898 | Kelley | 137/411 |
| 1,817,379 | 8/1931 | Kallmeyer | 137/411 |
| 1,891,214 | 2/1935 | Hoff et al. | 137/104 |
| 2,061,716 | 11/1936 | Pratt et al. | 137/411 X |
| 2,214,064 | 9/1940 | Niles | 166/54 |
| 2,257,523 | 9/1941 | Combs | 166/54 UX |
| 2,271,832 | 2/1942 | Shultz | 166/54 |
| 3,995,690 | 12/1976 | Valdespino | 166/54 X |
| 4,028,011 | 6/1977 | Kramer | 417/278 |

*Primary Examiner*—Stephen J. Novosad
*Attorney, Agent, or Firm*—Thomas Hooker

[57] ABSTRACT

A low well yield control system and method for preventing over pumping of wells and other fluid reservoirs. The control is positioned in the reservoir and includes a plurality of relief valves which are opened to replenish liquid in the reservoir from the pumped liquid in the event the liquid level is lowered relative to a float.

20 Claims, 7 Drawing Figures

Fig. 1
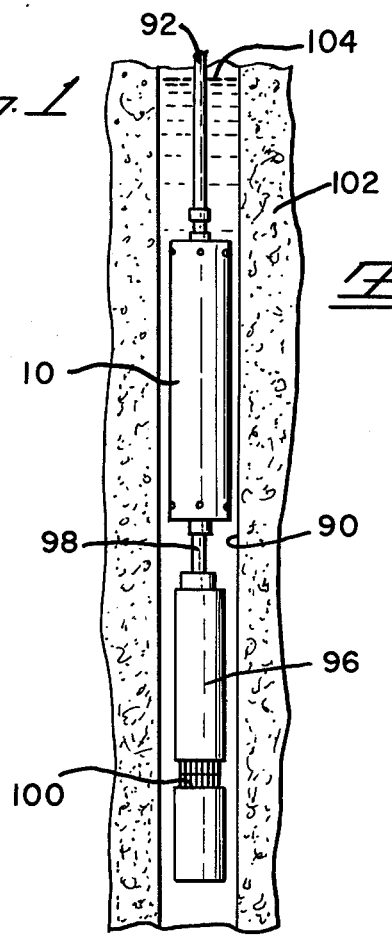
Fig. 2
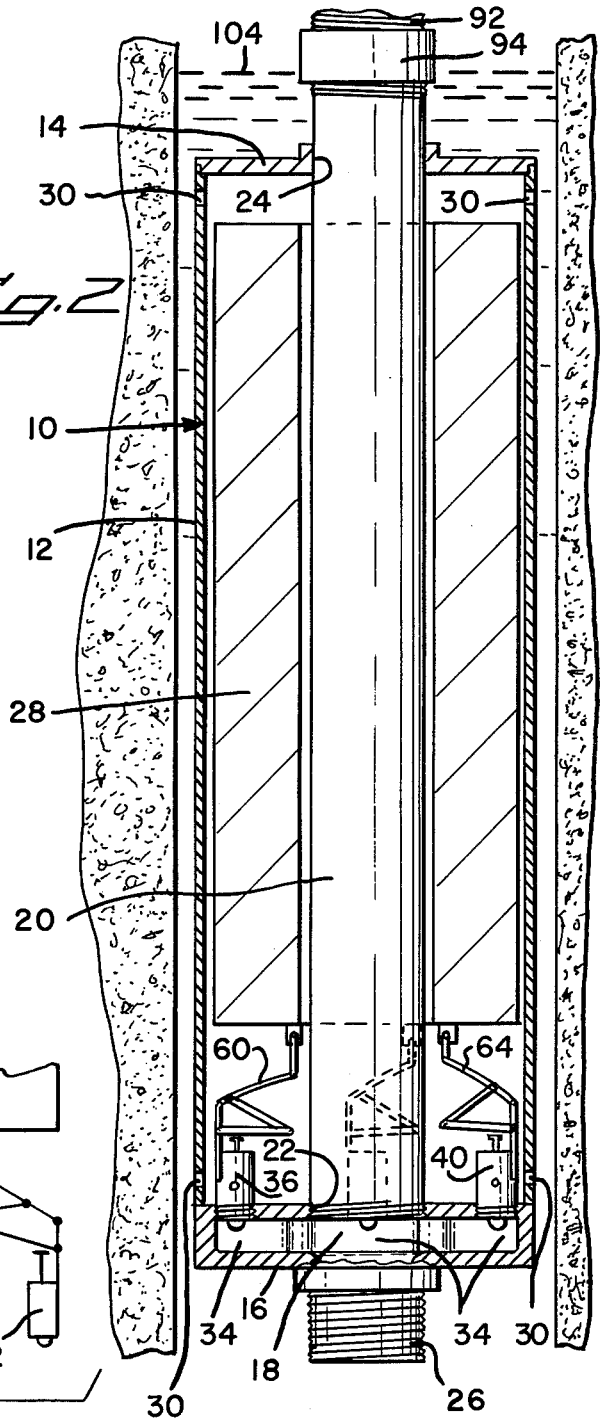
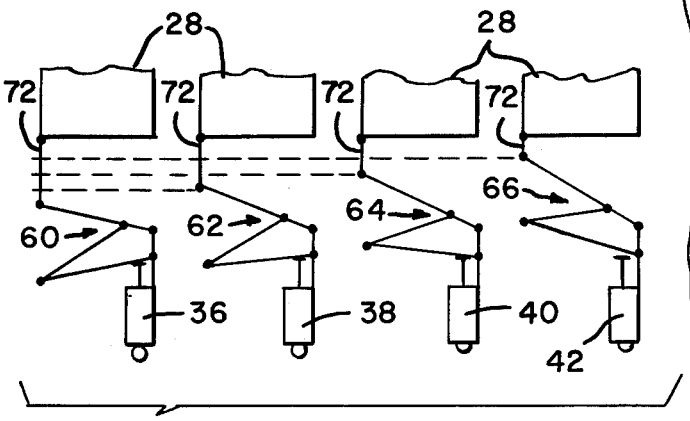
Fig. 5
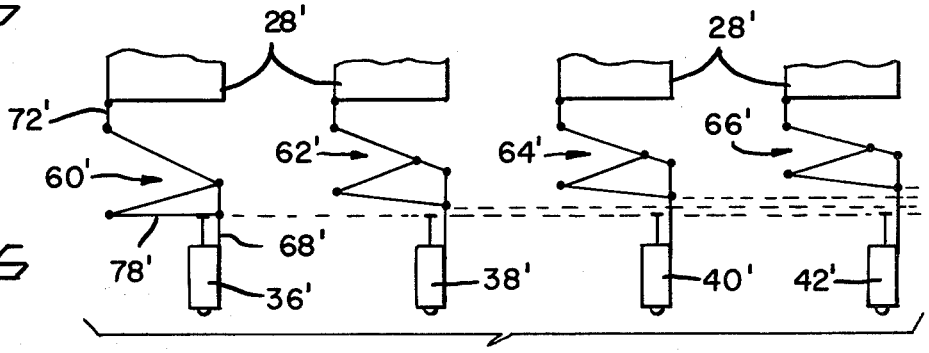
Fig. 6

LOW WELL YIELD CONTROL SYSTEM AND METHOD

This invention relates to an improved low well yield control system positioned in the riser pipe of a pumping system above the pump. The control system includes a plurality of relief valves communicating the interior of the riser pipe with the reservoir and a float for opening one or more of the valves in response to lowering of the level of the liquid in the reservoir. In the event pumping lowers level of the reservoir the valves open to permit pumped liquid to flow through them and back into the reservoir thereby replenishing the reservoir by providing sufficient liquid to meet the requirements of the pump. In this way, over pumping is avoided and cavitation eliminated. The plural valve system of the present invention represents improvement over the single valve control system disclosed in my prior U.S. Pat. No. 4,028,011.

In the present control system the plurality of relief valves are connected to the float through separate linkages. Lowering of the float collapses the linkages and opens the valves to flow liquid through the valves and back into the reservoir. The valves may be opened progressively so that with initial lowering of the float a first valve is open while the other valves remain closed. Further lowering of the float continues to open the first valve and commences opening of the second valve. Still further lowering of the float fully opens the first valve, continues to open the second valve and commences opening a third valve. In this way, the replenishing flow increases as the float is lowered and the pressure within the riser pipe is gradually and smoothly decreased avoiding undesirable hammering. The plural valves have sufficient capacity to handle the full output of the pump thus recirculating sufficient liquid back to the reservoir to prevent over pumping in the event the reservoir is not replenished from an external source. Any liquid flowing into the reservoir from such a source is pumped up the riser pipe.

The plural relief valve construction of the present invention uses four small poppet valves. These valves are less expensive than a comperable single flow valve of similar capacity. The use of the relatively small valves enables them and their linkages to be spaced around the circumference of the riser pipe in an efficient use of space so that the resultant control system has a relatively small outside diameter and is compatable for use with high capacity submersable pumps of like outside diameter. The portion of the riser pipe extending through the control system and past the spaced valves is straight thereby permitting a straight riser pipe from the output of the pump to the surface of the well. This construction eliminates frictional forces in the pumping operation. Additionally, with the use of a number of small valves it is possible to use relatively light linkages connecting them to the float. A single large volume control valve would require considerably a heavier linkage and large float with a resultant increase in the cost of the system.

While in the preferred embodiment of the invention, the plural relief valves are opened progressively, other embodiments using a plurality valves may include linkages which open the valves simultaneously or with pairs of valves opening together, one pair opening prior to opening of the other pair. The later arrangement is particularly adapted to dewatering applications.

Accordingly, an object of the invention is to provide an improved low well yield control system and method.

A second object of the invention is to provide a low well yield control having a plurality of relief valves.

A further object of the invention is to provide a low well yield control system with a plurality of relief valves and linkages connected to a float such that the valves are progressively opened and closed with lowering and raising of the float.

A further object of the invention is to provide a low yield control system comparable with a high capacity submersible pump where a plurality of relief valves open and close with a smooth fluctuation of pressure within the system.

Other objects and features of the invention will become apparent as the description proceeds, especially when taken in conjunction with the accompanying drawings illustrating the invention, of which there are two sheets.

IN THE DRAWINGS

FIG. 1 is a partially broken away view illustrating the control system as installed in a well;

FIG. 2 is an enlarged and further broken away view of the control system of FIG. 1;

FIGS. 5 and 6 are exploded representational views of different types of control linkages used to operate the valves of the invention.

DESCRIPTION OF THE INVENTION

Figure 3:
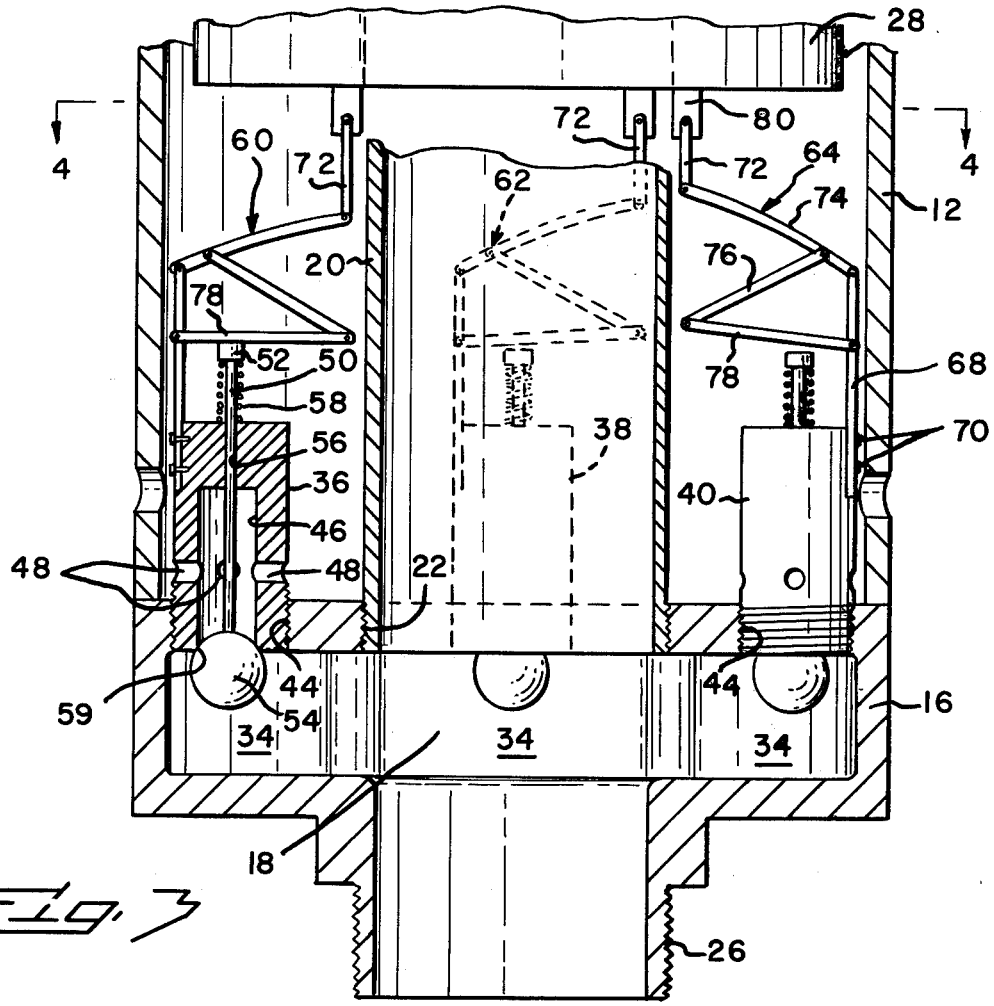
FIG. 3 is an enlarged view of the lower portion of FIG. 2.

Low well yield control 10, as shown in FIGS. 1 through 5, includes a cylindrical outer casing 12 with an upper end wall 14 closing the top of the casing and a lower casting 16 closing the bottom of the casing and including an interior chamber 18. A riser pipe segment 20 is threaded at the lower end thereof into the opening 22 in top of chamber 18 and extends up the casing and through an opening 24 in upper end wall 14. A threaded neck 26 extends downwardly from the bottom of casting 18.

The annular float or liquid level responsive member 28 is confined within the annular space within control 10 between pipe section 20 and the interior wall of casing 12. Ports 30 are formed through the wall of casing 12 at the top and bottom thereof to permit free flow of liquid into and out of the interior of the control. Additionally, drainage openings 32 extend through casting 16.

The chamber 18 in casting 16 includes four pockets 34 extending radially outwardly from the center of the chamber. Each pocket is located between an adjacent pair of drainage openings 32. Four relief valves 36, 38, 40 and 42 are secured to the top of casting 16 in threaded openings 44 with the bottom of each valve communicating with chamber 18.

Referring to FIG. 3, each relief valve includes an interior bore 46 with a pair of cross bores 48 communicating with the interior of the control 10. A valve stem 50 having head 52 on the upper end thereof and valving member 54 on the lower end thereof extends through passage 56 in the valve body. Spring 58, confined between the valve body and the head 52, biases the valving member 54 against valve seat 59 at the end of bore 46 opening into chamber 18.

Each relief valve 36, 38, 40 and 42 is connected to the float 28 by a separate linkage 60, 62, 64 and 66. While each linkage differs from the other linkages so that lowering of the float sequentially opens valves, each linkages contain a number of common parts including an upright support 68 secured to the body of the valve by a pair of mounting screws 70, a pair of connecting links 72 and 74 and a pair of actuating links 76 and 78. As illustrated in FIG. 3, links 72 and 74 are joined together at a pivot connection with the free end of link 72 pivotally connected to a mounting bracket 80 secured to the bottom of float 28 and with the free end of link 74 pivotally connected to the upper end of support 68. Links 76 and 78 are pivoted together with free end of link 76 pivotally connected to link 74 adjacent the end of support 68 and with the free end of link 78 pivotally connected to support 68. In the embodiment of FIG. 3, connection between each link 68 and support 78 is located slightly above the upper surface of the adjacent valve stem head 52 when the valve is closed and valving member 54 engages set 59. Linkages 60, 62, 64 and 66 differ in that each linkage uses a different length link 72. This link is longest in linkage 60 and is progressively shortened in linkages 62, 64 and 66. See FIGS. 3 and 5.

Vertical movement of the float 28 within casing 12 pivots link 74 about the end of support 68 and, depending upon direction of the movement of the float, collapses or expands links 76 and 78. Lowering of the float moves link 78 toward the head of the adjacent valve and raising the float moves the link away from the valve stem. The two pairs of linkages provide a force multiplication to assure proper opening of the valves. Sufficient lowering of the float will bring the link 78 of each respective linkage down against the valve stem head and will push the stem down against spring 58 to open the valve. Opening of the valve will allow pressurized liquid in the chamber 18 to flow into the respective pocket 34, through bores 46 and 48, into the casing 12 and then into the surrounding liquid through openings 30 and 32. When the float 28 is in the upper most position in the canister all of the valves are closed. Lowering of the float first collapses linkage 60, having the longest link 72, and starts to open valve 36. This valve continues to open as the float falls. When the valve is approximately half way open the linkage 62 begins to open valve 38. As valve 38 opens valve 36 is fully opened so that further collapse of linkage 60 moves the valving member further away from the seat but does not increase the flow through the valve. When valve 38 is approximately half way open valve 36 has been fully opened. When valve 36 is approximately half way open valve 40 commences to open and when this valve is approximately half way opened valve 38 is fully opened and the final valve 42 commences to open. Further lowering of the float fully opens valve 42 to provide maximum flow out of chamber 18. Raising of the float 28 closes the valves in exactly the reverse sequence outlined above.

Figure 4:
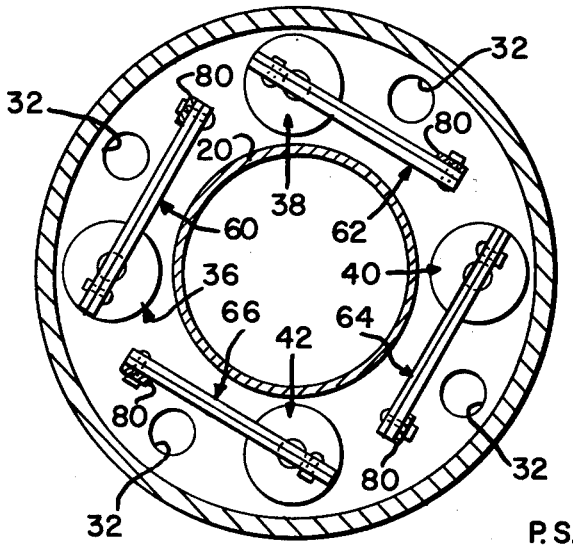
FIG. 4 is a sectional view taken along line 4—4 of FIG. 3.

As illustrated in FIG. 4, each bracket 80 is located between a pair of valves and is connected to the furthest away of the pair of valves by a linkage. Each linkage extends from its respective valve in the same circumferential direction so that the four linkages extend clockwise from their valves to between their respective mounting brackets. The linkages are free to expand and collapse in response to vertical movement of float 28. This arrangement makes efficient use of the available space between the exterior of pipe 20 and the interior of casing 12.

OPERATION OF THE INVENTION

Low well yield control system 10 is primarily intended for use in deep drilled wells as illustrated in FIG. 1. The control 10 is suspended in well 90 on riser pipe 92 which is joined to the upper end of pipe 20 by a coupling 94. An electric submersible pump 96 is supported by riser pipe section 98 which, in turn, is connected to neck 26 extending from the bottom of the control system 10. Pump 96 is conventionally powered by a constant speed electric motor so that in normal operation liquid flowing into the well 90 from the surrounding strata 102 is sucked into pump inlet 100 and pumped up the pipe section 98, through the control system 10 and thence up the riser pipe 92 to the top of the well. During normal operation of the control system the level 104 of the liquid in the well is above the control system so that the float 28 is in the upper position illustrated in FIG. 2, all the linkages are in the full up position and all of the valves are closed. In this position, link 78 of linkage 60 may rest lightly on the valve stem head 52 of closed valve 36. The valves are held closed both by the valve stems springs 58 and also by the pressure of the pumped liquid which biases the valving members 54 against their respective valve seats 59. The liquid pressure in chamber 18 during normal operation of the control 10 when the valves are closed is largely a function of the well head pressure determined by the height of the liquid column in the riser pipe.

Control 10 uses a straight riser pipe passage extending upwardly from the pump 96 without bends and thus avoids frictional pumping losses. This construction, in contrast to riser pipes with bends, maximizes the pumping efficiency and permits the use of a smaller pump then would be required in the event a control system were used in place of system 10 but with a large single valve having the capacity of the plural valves disclosed herein. The size of such a single valve would require that the riser pipe be laterally off set from the center line of the control in order to maintain the required outside diameter of the control and would introduce frictional losses.

Pump 96 removes liquid from the well and pumps it up the pipe 98 into the control unit 10 at a constant rate. This continues as long as the rate at which liquid flowing into the well equals or exceeds the rate at which the pump 96 removes liquid from the well. In the event the capacity of the pump exceeds the rate at which liquid flows into the well the reservoir of liquid in the well is depleted and liquid level 104 is lowered. This level is communicated into the interior of control system 10 by openings 30 and 32 so that as level is lowered in casing 12 float 28 falls and collapses the various valve linkages 60, 62, 64 and 66. As previously mentioned, when liquid level 104 is sufficiently high to hold float 28 in its uppermost position of FIG. 2 the link 78 of linkage 60 may rest lightly on the valve stem of valve 36.

Initial lowering of the float 28 pivots the link pairs of linkage 60 down and immediately pushes stem 50 down to begin to open valve 36. Opening of valve 36 permits a portion of the pressurized fluid pumped up through pipe 98 and into chamber 18 to be recirculated back into the well through the valve and the openings communicating the interior of the control system 10 with interior of the well. In the event that the initial opening of the valve 36 does not permit a sufficient recirculation flow of liquid back into the well to meet the constant volume requirements of pump 96, the float 26 will continue to fall and valve 36 will continue to open. During initial opening of valve 36 the linkages of the remaining valves are collapsed and their respective links 78 are brought closer to the valve stems. However, at this time none of the other valves start to open.

With further lowering of the liquid level the float 28 continues to fall and valve 36 continues to open. When this valve is approximately one-half fully open the link 78 of linkage 62 engages the valve stem of valve 38 and begins to open valve 38. With continued lowering of the float 28 valves 36 and 38 both thereby increasing the recirculation flow. When valve 38 is approximately half open valve 36 has been fully opened so that further downward movement of the valving member 54 of valve 36 will not increase the flow of liquid through the valve. At the same time link 78 of linkage 64 contacts the valve stem of valve 40 and commences to open valve 40 there by further increasing the recirculation flow.

When valve 40 is approximately half opened valve 38 has been fully opened and the link 78 of linkage 66 contacts the valve stem of valve 42 and commences to open valve 42. Further lowering of the float first fully opens valve 40 and then fully opens valve 42.

As liquid level 104 lowers an increasing portion of the liquid pumped up pipe 98 is recirculated back into the well to increase the supply of liquid in the well and thereby meet the requirements of the pump 96. The supply of liquid in the well is provided by both recirculating liquid and liquid flowing in the well from the surrounding strata. In the event the well is dry, that is that no liquid flows into it from the strata, the float will fall until the valves are opened sufficiently to recirculate the entire output of the pump. No liquid will be pumped up pipe 92 to the surface. In this way the control 10 prevents pump 96 from drawing the level of the liquid in the well down below the top of the pump and thereby assures that the pump has an adequate supply of liquid. Any liquid flowing into the pump from the strata increases the supply in the well and raises the float above its lower most position and thereby assures that this portion of the liquid in the well is pumped up the riser pipe to the surface. Thus, as more fully described in my prior U.S. Pat. No. 4,028,011, the control 10 assures that the well is pumped at a rate equalling the maximum capacity of the pump or the rate in which liquid flows into the well, in the event such rate is less than the capacity of the pump. The remaining output of the pump is recirculated.

The relatively long float 28 responds smoothly and slowly to movement of the liquid level 104 along its length. This float movement and the operation of the linkages assure that the valves in the control 10 are opened and closed smoothly and do not snap back and forth between opened and closed positions. As a result, the pressure of the liquid in chamber 18 does not change rapidly in a step-curve fashion during opening and closing of the valves. The valves do not bounce closed against the valve seat. Dangerous hammering is avoided. Hammering may occur when there is a high flow rate through a valve which is suddenly opened, thereby decreasing the pressure in the throat of the valve due to the Venturri effect so that the pressure on the upstream side of the valve forces the valve closed. Hammering vibrations may injure pumps and mechanical systems and are particularly disadventageous in deep wells where any injury requires pulling of the entire system up to the surface to make repairs.

Figure 7:
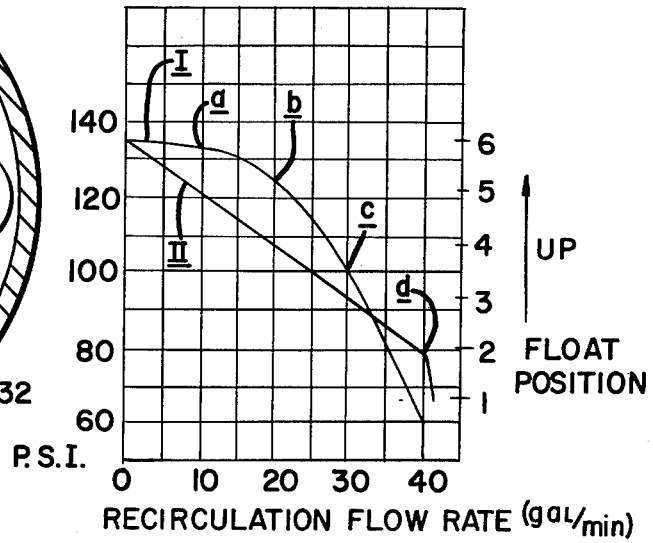
FIG. 7 is a graph of the liquid pressure in the control system verses the recirculation rate of the liquid pumped through the valves.

The sequential smooth opening and closing of the four relief valves in response to vertical movement of the float assures that the fluid pressure within chamber 18 is slowly and smoothly varied while the recirculation flow is increased or decreased to assure that liquid is supplied to the well at a rate at least sufficient to meet the requirements of the pump. FIG. 7 is a graph of the operating characteristics of a low well yield control system functionally identical to that shown in FIGS. 1 through 5. In this control system all of the links 72 were the same length and the lengths of the valve stems 50 were varied to provide sequential opening of the valves in exactly the same manner as the valves open in the disclosed control system 10. The control system was used in conjunction with a continuous speed high output submersible pump having a rated capacity of 40 gallons per minute. The tests indicated that the actual capacity of the pump was slightly greater than 40 gallons per minute. The test was conducted pumping water from a reservoir with a well head pressure in the control of 134.7 pounds per square inch which is the equivalent of a total well head of 310 feet.

In FIG. 7, the abscissa indicates the recirculation flow rate, that is the rate at which water flows out through the four relief valves of the control system. The graph shows two curves. Curve I plots the recirculation flow rate in gallons per minute versus the well head pressure in chamber 18 in pounds per square inch as indicated by the left hand ordinate scale. Curve II plots the recirculation flow rate versus the position of the float as indicated in the right hand ordinate scale. This scale reads from numbers 1 through 6, with number 1 being the full down position of the float and number 6 being the full up position of the float. The points a, b, c, and d on the graph I indicate positions of the valves at given pressure rates. At point a the first valve is approximately half way open and the second valve is commencing to open, at point b the first valve is fully opened, the second valve is approximately half opened and the third valve is beginning to open, point c indicates the second valve is fully opened, the third valve is approximately half opened and the fourth valve is commencing to open and at point d the third valve is fully opened and the fourth valve is approximately half opened.

The FIG. 7 graphs indicate that as the first valve begins to open the recirculation flow rate increases rapidly with a low initial drop of pressure in the control. As the float moves down to position 5 the first valve continues to open and the second valve starts to open thereby increasing the open valve area and continuing to increase the flow rate, although at a slower rate, while the rate of pressure drop increases more rapidly. Further lowering of the float opens additional valves and slowly and gradually increases the rate of pressure drop with increasing recirculation flow until the recirculation flow is increased to 40 gallons per minute and the first three valves are fully opened. The pump was found to have a pumping capacity slightly greater than 40 gallons per minute so that further lowering of the float from position 2 to position 1 resulted in only a slight increase in the recirculation flow rate.

While using a number of relatively small valves circumferentially spaced around the riser pipe it is possible to obtain smooth operational opening of the valves while maintaining the capacity of the control to recirculate the entire output of the high capacity pumps as required. Large single valve controls of the type having capacity to handle the entire output of the high capacity pump are very difficult to open and close at very low recirculation rates without hammering. Additionally, such single valves cannot be located within the casing without laterally offsetting the riser pipe and incurring additional frictional losses in the pumping operation. Use of a plurality of valves circumferentially spaced around the riser pipe in the annular space between the pipe and the casing provides a compact and efficient control system having a relatively small outside diameter matching the diameter of the pump intended to be used with the control. Thus, a control intended to be used in a well having an interior diameter of 6 inches using a high capacity pump having an outside diameter of 5¼ inches may be constructed with an outside diameter also of 5¼ inches, yet with the capacity of smoothly opening and closing to recirculate the entire output of the pump as described. Additionally, the small valves are operated by relatively light linkages in contrast to the heavy linkage required by a single large valve.

The flow of recirculated fluid gradually increases as the liquid level in the well falls and does not stream out of the control in a pulse or jet of tye type which would be experienced if a single recirculation valve were suddenly opened. Agitation of the liquid in the well is reduced minimizing the chance of distributing deposits on the sides of the well. It is desirable to leave these deposits undisturbed while pumping the well.

The use of a number of small valves spaced around the riser pipe permits the use of a larger diameter riser pipe for a control of a given outside diameter, thereby enabling the control to accomodate the output of high capacity pumps. If required, the length of the control 10 may be increased to provide a larger float in order to operate the valves and compensate for the decreased volume of the float resulting from the larger diameter riser pipe. This longer float provides a desired smooth opening of the valve as mentioned previously.

When a control 10 is installed in a very deep well the pressure in chamber 18 is quite high thereby providing a high force acting on the valving members 54 and resisting opening of the valves. The pressure in the bore 46 of the valves is that of the liquid in the well, conventionally much less than the well pressure in the chamber. This counter balancing pressure exerted on the valve members further assures slow and gradual opening of the valves, particularly as the first valve opens. If desired, a counter balancing pressure may be provided in all controls by strengthening springs 58 and thereby biasing the valve members against their respective seats. The downward force exerted by the float 28 upon lowering of liquid level must be sufficient to overcome the forces biasing the valve closed.

FIG. 5 illustrates the position of the linkages and valves of control 10 when the float has lowered to approximately position 5 on the graph of FIG. 7. Valves 36 and 38 are opening, valve 40 is about to open and valve 42 is closed.

FIG. 6 illustrates a second embodiment of the invention where different type of linkages are used to obtain the desired sequential opening of the control valves in exactly the same manner as described in connection with the embodiment of FIGS. 1 through 5. The control system of FIG. 6 is identical to the control systems of FIGS. 1 through 5 and includes a float 28' and four relief valves 36', 38', 40', and 42. Linkages 60', 62', 64' and 66' connect the float to the valves and are identical to the previously described linkages 60, 62, 64 and 66 with the exception that all of the links 72' are of the same length and the supports 68' are progressively longer from valve 36' to valve 42'. This increase in length of the supports 68' progressively raises the links 78' relative to the associated valve stems from valve 36' to 42' as illustrated. As float 28' lowers, the link 78' of linkage 60' first lowers the valve stem of the first valve 36' to commence opening it and, with further lowering of the float, the linkages 62', 64' and 66' successively open valves 38', 40' and 42' in exactly the same manner as described in connection with the embodiment of FIGS. 1 through 5.

Obviously, other types of linkages may be used to provide the desired sequential opening and closing of the relief valves.

In certain applications it may be useful to vary the sequence in which the flow relief valves are opened. For instance, when a pump and control are used in a dewatering application, the linkages may be adjusted so that a pair of valves open together and a second pair opens after the first pair has begun to open. In this application, rapid response is required and pressure drop considerations not important. The water is pumped directly into a discharge conduit and the pressure in the control is low. In some applications it may be desirable to use the same linkages for all four valves so that all four valves open and close together in response to movement of the float.

The low well yield control system is described with particular reference to use in a well with a constant speed electric pump. It is intended that this invention may be used in other environments and with other types of pumps than constant speed electrical pumps. The control may be used in wells with a different type of pump. For instance, the pump may be actuated by a drive shaft extending up the well to the surface. Other types of pumps may be used. The low well yield control system of the present invention may also be used to pump liquid from sources other than wells. The controls may be used advantageously with a pump for dewatering reservoirs subject to seepage or also may be used in commercial applications for pumping from a reservoir.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim my invention is:

1. A control system for preventing over pumping of a liquid from a liquid source, said system including a section of riser pipe; a plurality of relief valves secured to the riser pipe and spaced at intervals around the riser pipe; each valve including a passage communicating the interior of the riser pipe with the exterior of the control system so that liquid flowing through such passage is added to the reservoir and a valving member for fully opening and closing said passage; float means movable up and down relative to the riser pipe in response to change in the level of the liquid in the reservoir between uppermost and lowermost positions; and operator means connecting each valve to said float means so that the valving member of such valve is progressively moved to open the passage in response to lowering of said float means and to close the passage in response to raising of said float means; said operator means closing all of said valves when said float means is in the uppermost position and fully opening all of said valves when float means is in the lowermost position.

2. A control system as in claim 1 including a member attached to and extending around the riser pipe, said valves being mounted on the member at generally the same level on the riser pipe, the member including an interior chamber communicating the interior of the riser pipe with the passage of each valve, and wherein the operator means for each valve extends to one side of such valve and occupies the space between such valve and an adjacent valve, all said operator means extending from their respective valves in the same sense with respect to the riser pipe so that one operator means is between each adjacent pair of valves.

3. A control system as in claim 1 wherein, for each operator means, the connection joining the operator means to the float means is circumferentially spaced with respect to the riser pipe from the connection joining the operator means to a valve.

4. A control system as in claim 3 wherein said operator means for each valve includes a plurality of links, said links extending from their respective valves in the same circumferential direction around the riser pipe.

5. A control system as in claim 4 wherein all of said plurality of links extend above their respective valves toward said float means, in each set of links lying essentially in a plane.

6. A control system as in claim 5 wherein the valving member of each valve is located between the valve passage and the interior of the riser pipe and is opened by movement away from said passage against the pressure head in the riser pipe.

7. A control system as in claim 6 wherein each valve includes a spring biasing the valving member toward the closed position.

8. A control system as in claim 1 wherein upon lowering of the liquid level in the reservoir the float means is moved from the uppermost position to the lowermost position, first operator means commences to open a first valve at a first fluid level and continues to open such valve in response to lowering of the liquid level below said first position and second operator means commences to open a second valve at a second liquid level position and continues to open such valve with further lowering of the liquid level, said second liquid level position of the float being lower than said first liquid level position so that said first and second valves are opened sequentially and the recirculation flow is gradually and smoothly increased in response to lowering of the liquid level.

9. A control system as in claim 8 including at least three operating means and three valves wherein when the liquid level is lowered to a third position below said second position said third operator means commences to open a said third valve.

10. A control system as in claim 9 wherein said first operator means fully opens said first valve when said liquid level lowers approximately to said third position.

11. A control system as in claim 8 including a cylindrical casing surrounding the riser pipe and defining an annular space there between, said float means comprising an annular float vertically movable within said annular chamber and surrounding the riser pipe, including a member fixed to the pipe and defining an interior chamber communicating with the interior passage of the said valves, said valves being mounted on said member in spaced relation around the pipe and extending therefrom into the chamber, said operating means extending from each valve to said float, and including drainage openings for communicating the annular chamber with the exterior of the control system.

12. A control system for preventing over pumping of liquid from a reservoir including a riser pipe, a plurality of valves having discharge passages communicating the interior of the riser pipe with the exterior of the control system, a float vertically movable in response to change in the level of liquid in the reservoir, and a connection extending from each valve to the float for opening and closing the valve in response to the vertical position of the float, a first connection operable to commence opening a first valve when the float is in a first position and said second connection operable to commence opening a second valve when the float is in a second position located below said first position so that said valves open sequentially upon lowering of the float.

13. A control system as in claim 12 wherein said second valve begins to open before said first valve is fully opened.

14. A control system as in claim 13 including a third valve and a third connection joining said such valve to the float, said third connection being operable to commence opening said third valve before said second valve is fully opened.

15. A control system as in claim 14 including four valves and an annular float surrounding the riser pipe located above the valves, each valve including a valve stem, the connections joining said valves to said float comprising individual linkages for each valve each having a movable portion engagable with the valve stem to control opening of the valve and a force multiplication portion secured to the float such that lowering of the float moves said movable portion into engagement with the valve stem to begin opening the valve at a given liquid level and the valve continues to open with falling of the float.

16. A control system as in claim 15 wherein each linkage extends from a valve in the same circumferential direction around the riser pipe and occupies a space between such valve and the next adjacent valve.

17. The method of pumping liquid from a reservoir without over pumping, comprising the steps of:

A. Pumping liquid into a riser pipe at a given rate;

B. Upon lowering of the liquid in the reservoir to a first level commencing to open a first valve communicating the interior of the pipe with the reservoir and thereby flowing liquid through said valve back into the reservoir to replenish the same;

C. Continuing to open the first valve as the level falls below the first level;

D. With lowering of the liquid to a second level below the first level commencing to open a second valve communicating the interior of the pipe with the reservoir to flow additional liquid through the second valve back into the reservoir; and E. Continuing to open the second valve as the level falls below said second level.

18. The method of claim 17 including the step of continuing to open both said first and second valves as the level falls below said second level.

19. The method of claim 18 including the steps of commencing to open a third valve communicating the interior of the pipe with the reservoir when the liquid in the reservoir falls to a third level below said second level and continuing to open said second and third valves when said level falls below the third level.

20. The method of pumping liquid from a reservoir and recirculating liquid back to reservoir from the pumped liquid including the steps of smoothly and progressively opening a plurality of valves located in the path of recirculation flow in response to lowering of the liquid level in the reservoir, all of said valves commencing to open one after the other and commencing to open at least one of said valves during opening of another valve.

* * * * *

UNITED STATES PATENT OFFICE

CERTIFICATE OF CORRECTION

PATENT NO. : 4,173,255

DATED : November 6, 1979

INVENTOR(S) : Richard W. Kramer

It is certified that error appears in the above-identified patent and that said Letters Patent are hereby corrected as shown below:

Column 1, line 44 change "comperable" to --comparable--;
line 49 change "compatable" to --compatible--;
line 50 change "submersable" to --submersible--;
line 59 change "considerably a" to --a considerably--;
and line 64 after "plurality" insert --of--.

Column 2, line 34 change "verses" to --versus--.

Column 3, line 8 change "linkages contain" to --linkage contains--;
line 21 before "connection" insert --the--; and after "and" insert --its--; and line 43 change "upper most" to --uppermost--.

Column 4, line 38 change "then" to --than--; and line 42 change "off set" to --offset--.

Column 5, line 14 change "thereby decreasing" to --open to decrease--; line 21 change "there by" to --thereby--;
line 44 change "lower most" to --lowermost--; and
line 66 change "Venturri" to --Venturi--.

Column 6, line 1 change "disadventageous" to --disadvantageous--.

Column 7, line 35 change "accomodate" to --accommodate--;
line 63 after "where" insert --a-- and change "are" to --is--.

UNITED STATES PATENT OFFICE

CERTIFICATE OF CORRECTION

PATENT NO. : 4,173,255

DATED : November 6, 1979

INVENTOR(S) : Richard W. Kramer

It is certified that error appears in the above-identified patent and that said Letters Patent are hereby corrected as shown below:

Column 8, line 1 change "42" to --42'--; and line 24 before "not" insert --are--.

Column 9, line 29 change "in" to --and-- and "lying" to --lies--; line 43 change "fluid" to --liquid--; line 45 change "position" to --liquid level--; lines 47, 49 and 50 delete "position"; line 55 change "operating" to --operator--; and lines 56, 57 and 61 change "position" to --liquid level--.

Column 10, line 15 after the comma insert --the connection including--.

Signed and Sealed this

*Nineteenth* Day of *February 1980*

[SEAL]

*Attest:*

SIDNEY A. DIAMOND

*Attesting Officer*

*Commissioner of Patents and Trademarks*